US006503677B1

(12) United States Patent
Gutman et al.

(10) Patent No.: US 6,503,677 B1
(45) **Date of Patent: *Jan. 7, 2003**

(54) EMULSION AGGREGATION TONER PARTICLES COATED WITH NEGATIVELY CHARGEABLE AND POSITIVELY CHARGEABLE ADDITIVES AND METHOD OF MAKING SAME

(75) Inventors: Edward J. Gutman, Webster, NY (US); Bernard Grushkin, Bedford, MA (US); John G. Ruhland, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/901,085

(22) Filed: Jul. 10, 2001

(51) Int. Cl.[7] ..... G03G 9/097

(52) U.S. Cl. ..... 430/108.3; 430/137.1

(52) U.S. Cl. .....

(58) Field of Search ..... 430/108.3, 137.1

(56) References Cited

U.S. PATENT DOCUMENTS

| | | | | |
|---|---|---|---|---|
| 4,935,326 | A | 6/1990 | Creature et al. | |
| 4,937,166 | A | 6/1990 | Creatura et al. | |
| 4,973,540 | A | 11/1990 | Machida et al. | |
| 5,236,609 | A | 8/1993 | Mahabadi et al. | |
| 5,376,172 | A | 12/1994 | Tripp et al. | |
| 5,429,873 | A | 7/1995 | Deuser et al. | |
| 5,484,675 | A | 1/1996 | Tripp et al. | |
| 5,916,725 | A | 6/1999 | Patel et al. | |
| 6,087,059 | A | 7/2000 | Duggan et al. | |
| 6,120,967 | A | 9/2000 | Hopper et al. | |
| 6,210,851 | B1 | 4/2001 | Srinivasan et al. | |
| 6,291,121 | B1 * | 9/2001 | Hollenbaugh et al. | 430/108.7 |
| 6,365,316 | B1 * | 4/2002 | Stamp et al. | 430/107.1 |

* cited by examiner

*Primary Examiner*—Mark A. Chapman
(74) *Attorney, Agent, or Firm*—Oliff & Berridge, PLC; Eugene O. Palazzo

(57) ABSTRACT

An emulsion aggregation toner particularly adapted for use in hybrid scavengeless development includes toner particles of polymer binder, colorant and a surface additive package containing at least one additive negatively chargeable to a carrier and at least one additive positively chargeable to the carrier. The toner is able to exhibit high stable triboelectric charging ability, and substantially eliminates charge through and slow admix in a developer employing the toner.

23 Claims, No Drawings

EMULSION AGGREGATION TONER PARTICLES COATED WITH NEGATIVELY CHARGEABLE AND POSITIVELY CHARGEABLE ADDITIVES AND METHOD OF MAKING SAME

BACKGROUND OF THE INVENTION

1. Field of the Invention

The present invention pertains to emulsion aggregation toners coated with a coating comprised of a mixture of a negatively chargeable additive and a positively chargeable additive, a method of making such coated emulsion aggregation toners, and a method of preparing a developer that contains such coated toner particles and exhibits rapid admix and little or no charge through.

2. Discussion of Related Art

Hybrid scavengeless development (HSD) technology develops toner via a conventional magnetic brush onto the surface of a donor roll. A plurality of electrode wires is closely spaced from the toned donor roll in the development zone. An AC voltage is applied to the wires to generate a toner cloud in the development zone. This donor roll generally consists of a conductive core covered with a thin, for example 50–200 m, partially conductive layer. The magnetic brush roll is held at an electrical potential difference relative to the donor core to produce the field necessary for toner development. The toner layer on the donor roll is then disturbed by electric fields from a wire or set of wires to produce and sustain an agitated cloud of toner particles. Typical AC voltages of the wires relative to the donor are 700–900 Vpp at frequencies of 5–15 kHz. These AC signals are often square waves, rather than pure sinusoidal waves. Toner from the cloud is then developed onto the nearby photoreceptor by fields created by a latent image. To operate effectively within these operating parameters, imaging devices employing HSD require toners that charge at high levels, for example between about −30 $\mu$C/g and about −45 $\mu$C/g.

The properties of a toner are set through the selection of materials and amounts of the materials of the toner. The charging characteristics of a toner are also dependent upon the carrier used in a developer composition, in particular the carrier coating. Toners typically comprise at least a binder resin, a colorant and one or more external surface additives. The external surface additives are generally added in small amounts. Examples of external surface additives include, for example, silica, titanium dioxide, zinc stearate, etc.

Toners having a triboelectric charging property within the range of about −30 $\mu$C/g and about −45 $\mu$C/g may be achieved when using small sized silica particles as external additives, for example silica particles having average sizes less than 20 nm, such as, for example, R805 (~12 nm) and/or R972 (~16 nm). However, the developability at areas of low toner area coverage degrade over time. This has been attributed to the small sized additives being impacted into the toner surface over time.

The above problem with small sized additives has been addressed by using larger sized additives, i.e., additives having a size of 40 nm or larger such as, for example, RX50 silica, RX515H silica or SMT5103 titania. However, although the above problem is addressed, the toners do not exhibit as high a triboelectric charging ability and also exhibit charge through (discussed more fully below). Moreover, new carrier coatings are being developed that enable higher charging developers, particularly those with larger size additive packages, but when such developers are tested at low area coverage followed by high area coverage, the developers tend to exhibit low or wrong sign toner due to charge through, i.e., the incumbent toner in the device becomes less negative or even wrong sign, i.e., positive, and the new (fresh) toner added may charge very negative. The presence of low charge and/or wrong sign toner can result in objectionable background.

U.S. Pat. No. 6,087,059, incorporated herein by reference in its entirety, describes a toner comprised of resin, colorant and a surface additive mixture comprised of two coated silica's, and a coated metal oxide, and wherein the two coated silica's are comprised of a first silica and a second silica, and wherein the first coated silica contains a coating of an alkyl silane and an amino alkyl silane.

U.S. Pat. No. 6,210,851, incorporated herein by reference in its entirety, describes an electrostatographic toner comprising toner particles that have been surface treated with a solvent and silica particles having a BET surface area of 40 to 400 $m^2/g$; wherein the solvent is selected from aliphatic alcohols, diols and triols, aliphatic ketones, aliphatic esters, cyclic ethers and aliphatic ethers.

U.S. Pat. No. 5,484,675, incorporated herein by reference in its entirety, describes a toner composition comprised of resin and pigment particles where the pigment particles are treated with a fluorosilane polymer.

U.S. Pat. No. 4,973,540 describes a developer for developing electrostatic latent images formed on an electrostatic latent image carrier, which comprises a toner including; a resin, a colorant, and an inorganic fine particle with at least both a negatively chargeable polar group and a positively chargeable polar group on the surface of the inorganic fine particle. The negatively chargeable polar group contains fluorine atoms at a content of from 0.005 to 6% and the positively chargeable polar group contains nitrogen atoms at a constant of from 0.04 to 5%, the contents being selected within these ranges to provide the inorganic fine particle with either.a positive or negative charge. The inorganic fine particles are selected from the group consisting of silicon dioxide, silicate, titanium dioxide, alumina, magnesium carbonate, barium titanate and zinc oxide.

U.S. Pat. No. 5,429,873 describes surface-modified, pyrogenically produced silicon dioxide obtained by placing a pyrogenically produced silicon dioxide in a mixing device, spraying it with a chemical compound from the group: $CHF_2—CF_2—O—(CH_2)_3—Si(OCH_3)_3$, $CF_3—CHF—CF_2—O—(CH_2)_3—Si(OCH_3)_3$, $C_4F_9—CH_2—Si_2—(OCH_3)_3$, and $C_6F_{13}—CH_2—CH_2—Si(OCH_3)_3$ with intensive mixing, subsequently mixing it and tempering the mixture obtained for a fairly long time. The surface-modified silicon dioxide is described to be used in toners.

U.S. Pat. No. 5,376,172, incorporated herein by reference in its entirety, describes a process for preparing silane modified metal oxides comprising reacting a metal oxide with an amine compound with or without water present on the surface of the metal oxide to form an amine metal oxide surface intermediate, optionally removing excess unreacted amine, and subsequently reacting the intermediate with an organosilane. The organosilane is of the formula $Si(X)_n(R_m)_{4-n}$ where Si is a silicon atom, X is a leaving group selected from the group consisting of halogen and alkoxy, R is an alkyl, alkenyl, alkynyl, aryl, alkaryl, aralkyl, or the halogenated derivatives thereof; m is an integer with a value of at least 1; and n is an integer of 1 to 3.

What is still desired is a toner having a surface additive package that substantially eliminates charge through and slow admix, as well as enables high triboelectric charging, and which toner is particularly suitable for use in an imaging device utilizing HSD.

SUMMARY OF THE INVENTION

It is therefore an object of the present invention to develop a toner capable of high triboelectric charging but that does not exhibit charge through or slow admix.

It is a still further object of the present invention to develop a surface additive package for a toner that enables the foregoing properties.

It is a still further object of the present invention to develop a toner and developer that can be suitably used in an imaging device employing hybrid scavengeless development.

These and other objects of the present invention are achieved herein, wherein in embodiments the invention relates to an emulsion aggregation toner comprised of toner particles comprising polymer binder and colorant and a surface additive package comprising at least one additive negatively chargeable to a reference carrier (negative additive) and at least one additive positively chargeable to a reference carrier (positive additive), and preferably also titania particles and/or zinc stearate. The charging polarity of an additive can be readily obtained, for example from vendors' literature for commercial products or from known evaluation techniques.

A method of preparing the emulsion aggregation toner comprises forming toner particles comprised of polymer binder and colorant by emulsion aggregation, and incorporating a surface additive package comprising at least one negative additive and at least one positive additive onto the surface of the toner particles.

These and other objects are also achieved by a developer comprising toner and carrier, wherein the toner of the developer comprises toner particles comprising polymer binder and colorant and a surface additive package comprising at least one negative additive and at least one positive additive, and preferably also titania particles and/or zinc stearate.

One method of making a developer comprised of emulsion aggregation toner and carrier comprises determining the charging effect the carrier imparts to the toner at a selected concentration of toner to carrier; preparing a surface additive package comprising a mixture of at least one negative additive and at least one positive additive, wherein the ratio of the negative additive to the positive additive in the mixture is selected based upon the determined charging effect, the additive package also preferably including titania particles and/or zinc stearate; incorporating the surface additive package onto the toner; and subsequently mixing the toner and the carrier.

DETAILED DESCRIPTION OF PREFERRED EMBODIMENTS

The toners that are particularly suitable for use with hybrid scavengeless development are preferably emulsion aggregation toners. That is, the toner particles of the toner, which comprise at least polymer binder and colorant, are derived via known emulsion aggregation techniques. The toner particles may be characterized as aggregated, fused toner particles as a result of the emulsion aggregation formation process.

Preferably, two main types of emulsion aggregation toners may be used herein. First is an emulsion aggregation process that forms acrylate based, e.g., styrene acrylate, toner particles and in which surfactants are used in forming the latex emulsion. See, for example, U.S. Pat. No. 6,120,967, incorporated herein by reference in its entirety, as one example of such a process. Second is an emulsion aggregation process that forms polyester, e.g., sodio sulfonated polyester, and which is a surfactant-free process. See, for example, U.S. Pat. No. 5,916,725, incorporated herein by reference in its entirety, as one example of such a process.

Briefly, emulsion aggregation techniques typically involve the formation of an emulsion latex of the resin particles, which particles have a small size of from, for example, about 5 to about 500 nanometers in diameter, by heating the resin, optionally with solvent if needed, in water, or by making a latex in water using an emulsion polymerization. A colorant dispersion, for example of a pigment dispersed in water, optionally also with additional resin, is separately formed. The colorant dispersion is added to the emulsion latex mixture, and an aggregating agent or complexing agent is then added to form aggregated toner particles. The aggregated toner particles are heated to enable coalescence/fusing, thereby achieving aggregated, fused toner particles.

Emulsion aggregation techniques achieve aggregated, fused toner particles that are able to have a desirable small average particle size without requiring mechanical grinding, and that have excellent size distribution without requiring extensive screening operations to remove particles that are too large or too small. The aggregated, fused toner particles of the present invention preferably have a volume average diameter of from about 1 to about 15 microns, preferably from 1 to about 10 microns and more preferably from about 3 to about 9 microns, and a narrow geometric size distribution (GSD) of, for example, from about 1.05 to about 1.25, preferably from about 1.05 to about 1.20, as measured on a Coulter Counter. As the resin of the emulsion aggregation toners of the present invention, any resin amenable to use in the emulsion aggregation method may be selected without limitation, numerous suitable examples being identified in the above-mentioned Xerox patents. Appropriate aggregating or complexing agents for use in aggregating the selected resin may also be selected as described in any of these patents. The colorant may be, for example, dyes, pigments, mixtures thereof, mixtures of pigments, mixtures of dyes, and the like, although the use of pigments and pigment mixtures is preferred. The colorant may have a color of, for example, black (e.g., carbon black), cyan, yellow, magenta, or mixtures thereof. The colorant preferably has a mean colorant size ranging from about 50 to about 150 nanometers.

Various known colorants such as dyes or pigments are present in the toner in an effective amount of, for example, from about 1 to about 25 percent by weight of the toner, and preferably in an amount of from about 1 to about 15 weight percent of the toner.

Colorants that may be used include magnetites such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™. A suitable black pigment that may be used is, for example, carbon black like REGAL 330™ and the like. As colored pigments, there can be selected pigments of cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan pigments include copper tetra (octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. The colorant may also be comprised of a predispersed pigment such as are commercially available. Example preferred pigment dispersions include, for example, the FLEXIVERSE series and the SUNSPERSE series of pigment dispersions from Sun Chemical. Some of these are Blue 15:3 (BFD-1121), Blue 15 (BFD-1149), Blue 61 (BFD-9516), Red 81:2 (RFD 9664), Red 22 (RFD-4241), Yellow 14 (YFD-1123), Yellow 17 (YFD-4249), Black Regal 660 (LFD-4343), Green 7 (GFD-1151), Green 36 (GHD-7114), Violet 19 (QFD-1180) and Violet 23 (VFD-1157).

In addition to the resin and colorant, there can be included in the toner compositions of the present invention charge additives in various effective amounts, such as from about 1 to about 20, and preferably from about 1 to about 5, weight percent, and waxes, such as polypropylenes and polyethylenes commercially available from Allied Chemical and Petrolite Corporation, EPOLENE N-15 commercially available from Eastman Chemical Products, Inc., VISCOL 550-P, a low weight average molecular weight polypropylene available from Sanyo Kasei K. K., and the like. The wax may be present in the toner composition of the present invention in various amounts, however, generally these waxes are present in the toner composition in an amount of from about 1 percent by weight to about 15 percent by weight, and preferably in an amount of from about 2 percent by weight to about 10 percent by weight. The toners of the present invention may also include polymeric alcohols, such as UNILINS available from Petrolite Corporation.

The emulsion aggregation toners of the present invention also include a surface additive package thereon, which additive package comprises at least one negative additive, i.e., an additive that is negatively charged upon triboelectric contact with a reference carrier, and at least one positive additive, i.e., an additive that is positively charged upon triboelectric contact with the reference carrier. The additive package also most preferably includes titania and zinc stearate.

In developer compositions, it is desired that toner freshly added to a device rapidly gain charge to the same level of the incumbent toner in the developer. If this is not the case, two distinct situations may occur. When freshly added toner fails to rapidly charge to the level of the toner already in the developer, a situation known as "slow admix" occurs. Distributions can be bimodal in nature, meaning that two distinct charge levels exist side-by-side in the development subsystem. In extreme cases, freshly added toner that has no net charge or wrong sign charge may be available for development onto the photoreceptor. Conversely, when freshly added toner charges to a level higher than that of toner already in the developer, a phenomenon known as "charge through" occurs. Also characterized by a bimodal distribution, in this case the low charge or wrong sign polarity toner is the incumbent toner (or toner that is present in the developer prior to the addition of fresh toner). Particularly for use in HSD, the distribution of charge must not contain excessive amounts of high or low (especially opposite polarity) toner charge. HSD is very sensitive to low charge toner since all of the toner that reaches the photoreceptor (both image and background) may be recharged during the process. Low charge toner (and certainly toner of the opposite polarity) will likely develop to the background region, and after recharging can be transferred to the print. Low charge toner also contributes to an accumulation of toner on the surface of the wires that are situated between the donor roll and photoreceptor in an HSD development system, which can cause differential development (spatially and temporally) leading to noticeable image quality defects, a condition called wire history. The distribution must also not contain excessive amounts of high charge toner, as this will reduce developability and transfer. The failure modes for both slow admix and charge through are thus most notably background and dirt in the machine, wire history, interactivity, and poor text and graphic quality.

It has been surprisingly found by the present inventors that through the appropriate selection of a surface additive package that includes at least both a negative additive and a positive additive, as well as preferably titania and zinc stearate, charge through and slow admix can be substantially eliminated, and high triboelectric charging such as required in an imaging developing device employing HSD can be achieved.

By negative additives that are negatively chargeable to a reference carrier is meant that the additives are negatively charging relative to the toner surface measured by determining the toner triboelectric charge with and without the additive. Similarly, by positive additives that are positively chargeable to a carrier is meant that the additives are positively charging relative to the toner surface measured by determining the toner triboelectric charge with and without the additive.

Negative additives that are negatively chargeable to a carrier include, for example, silica particles, alumina particles, or any small sized particles (e.g., from about 7 to about 100 nm in volume average particle diameter as determined by any suitable technique) including, for example, polymeric microspheres, optionally treated with a composition rendering the particles negatively chargeable to a carrier upon triboelectric contact therewith. The treating material may be, for example, a fluorosilane, for example a fluorosilane such as exemplified in U.S. Pat. No. 4,973,540, incorporated herein by reference, other halogen-containing organosilanes such as described in U.S. Pat. No. 5,376,172, incorporated herein by reference, silazanes, siloxanes, etc.

As specific examples of additives negatively chargeable to a carrier, mention may be made of NA50HS obtained from DeGussa/Nippon Aerosil Corporation, having a size of approximately 40 nanometers (average primary particle size), and coated with a mixture of hexamethyldisilazane and aminopropyltriethoxysilane, untreated silica, such as OX50 made by Degussa/Nippon Aerosil and having a size of approximately 50 nm, silica treated with hexamethyldisilazane, such as RX50 made by Degussa/Nippon Aerosil and having a size of approximately 40 nm, silica treated with a mixture of hexamethyldisilazane and aminopropyltriethoxysilane, such as RX515H made by Degussa/Nippon Aerosil and having a size of approximately 40 nm, silica treated with polydiemthylsiloxane, such as TG308F made by Cabot and octylsilane treated silica, such as R805, made by Degussa/Nippon Aerosil and having a size of approximately 12 nm.

Positive additives that are positively chargeable to a carrier include, for example, silica particles, alumina particles, or any small sized particles (e.g., from about 7 to about 100 nm in volume average particle diameter as determined by any suitable technique) including, for example, polymeric microspheres, treated with a composition rendering the particles positively chargeable to a carrier upon triboelectric contact therewith. The treating material may be, for example, an alkylsilane such as butyl, hexyl, octyl, decyl, dodecyl or stearyl silane, or an aminosilane, and wherein each alkyl of said alkylsilane and said aminoalkylsilane contains from about 1 to about 25 carbon atoms. Suitable amine-containing treating materials include those identified in U.S. Pat. No. 4,973,540, incorporated herein by reference.

As specific examples of additives positively chargeable to a carrier, mention may be made of H2050 silica treated with polydimethylsiloxane units or segments, and having amino/ammonium functions (available from Wacker Chemie) and H2015 treated with PDMS/amino-ammonium silane, also available from Wacker Chemie.

The additive package preferably includes from about 0.5% to about 15%, preferably about 1.0% to about 5.0%, by weight of the toner of the negatively chargeable additive(s) and from about 0.5% to about 12%, preferably about 0.5% to about 4.0%, by weight of the toner of the positively chargeable additive(s). Preferably, the ratio of the negatively chargeable additive(s) to the positively chargeable additive (s) in the additive package ranges from, for example, about 90:10 to about 30:70, preferably about 70:30 to about 34:66, weight basis. The ratio can be determined, i.e., "tuned," with respect to a given carrier coating as can be readily determined through routine experimentation within the skill of a practitioner in the art. In other words, the optimal ratio range of negative additives to positive additives varies for a particular carrier coating. In general, for more "positive" carriers, i.e., for carriers having coatings that impart a greater negative charge to a toner, more positive additives should be present in the additive package. Accordingly, in the process of formulating an optimal additive package for a toner of a developer, the charging effect, e.g., the level of charging and admix time, that the carrier of the developer imparts to the toner at the selected concentration of toner to carrier should first be determined, and then the surface additive package comprised of a mixture of at least one negative additive and at least one positive additive, and also preferably titania and zinc stearate, should be prepared, the ratio of the negative additive to the positive additive in the mixture being selected (derived) based upon the determined charging effect.

In a preferred embodiment, the total additive package also includes titanium dioxide particles, with or without surface treatment, in addition to the negative additives and positive additives. The titania is preferably present in an amount from about 1% to about 5%, more preferably about 1.5% to about 3.0%, by weight of the toner. A suitable titania for use herein is, for example, SMT5103 available from Tayca Corp., a titania having a size of about 25 to about 55 nm treated with decylsilane. It should be noted that while titania is positively chargeable to a carrier, it is not present in the additive package of the present invention as the sole positive additive. In other words, when present, titania is not the only positive additive present, and it is not used at all in determining the ratio of negative additive to positive additive. Thus, when titania is present in the additive package, the additive package comprises at least titania, negative additive (s) and positive additive(s).

The presence of a titania in the additive package improves the relative humidity stability of the toner. For example, the toner is substantially insensitive to relative humidities of, for example, about 10 to about 40 percent relative humidity at temperatures of from about 60° F. to about 80° F. as determined in a relative humidity testing chamber.

In another preferred embodiment of the invention, the toner and/or additive package also includes a conductivity aid, for example a metal salt of a fatty acid such as, e.g., zinc stearate. A suitable example includes Zinc Stearate L from Ferro Corp. Such a conductivity aid may be present in an amount from about 0.10% to about 1.00% by weight of the toner.

The toners of the invention are thus emulsion aggregation toner particles comprised of polymer binder and colorant, and having a surface additive package as described herein. The toners exhibit high stable triboelectric charging characteristics from for example about −30 to about −60 microcoulombs per gram, and are thus suitable for use in imaging devices utilizing HSD. Moreover, the toners are able to substantially eliminate charge through and slow admix, i.e., the toner and developer compositions with the mixture of certain surface additives enable desirable admix properties of about 1 second to about 60 seconds as determined by the charge spectrograph, and more preferably less than about 30 seconds, enable the development of images in electrophotographic imaging apparatuses, in particular HSD devices, which images have substantially no background deposits thereon, are substantially smudge proof or smudge resistant, and therefore are of excellent resolution.

The toners are made by first forming the particles thereof by emulsion aggregation and then the surface additive mixture and any other additives are incorporated onto the aggregated, fused particles, for example by the blending thereof with the particles obtained. The overall coating weight of the additive package, based on the weight of the toner, should be, for example, about 1% to about 15% by weight, preferably about 5% to about 8% by weight.

Developer compositions can be prepared by mixing the toners with known carrier particles, including coated carriers, such as steel, ferrites, and the like, reference U.S. Pat. Nos. 4,937,166 and 4,935,326, the disclosures of which are totally incorporated herein by reference, for example from about 2 weight percent toner concentration to about 8 weight percent toner concentration. The carriers can include coatings thereon, such as those illustrated in the U.S Pat. No. 4,937,166 and U.S. Pat. No. 4,935,326 patents, and other known coatings. There can be selected a single coating polymer, or a mixture of polymers. Additionally, the polymer coating, or coatings, may contain conductive components therein, such as carbon black in an amount, for example, of from about 10 to about 70 weight percent, and preferably from about 20 to about 50 weight percent. Specific examples of coatings are fluorocarbon polymers, acrylate polymers, methacrylate polymers, silicone polymers, polyurethanes, and the like.

EXAMPLES

The carriers used in the following examples to further illustrate the invention and preferred embodiments thereof are described as follows.

A grit core, approximately 65 microns in diameter, obtained from Hoeganaes Corp was coated with a variety of polymers to obtain several carriers. All the coatings were 1% by weight. The carriers are as follows:

Carrier A: A powder coating of a polymethylmethacrylate (PMMA) polymer (obtained from Soken Chemical).

Carrier B: A powder coating of polymethylmethacrylate polymer containing about 20 weight percent carbon black made by a semisuspension polymerization process with a volume median particle size of between 2 and 3 microns, reference for example commonly owned and assigned U.S. Pat. No. 5,236,629, the disclosure of which are incorporated in its entirety herein by reference.

Carrier C: A powder coating of a mixture of ENVIROCRON®, a polyester urethane powder, commercially available from P.P.G. Industries, Inc., premixed in an 80:20 weight ratio (C1), or a 60:40 weight ratio (C2), or a 40:60 weight ratio (C3) in a blender with a polymethylmethacrylate polymer containing about 20 weight percent carbon black made by a semisuspension polymerization process with a volume median particle size of between 2 and 3 microns, reference for example commonly owned and assigned U.S. Pat. No. 5,236,629, the disclosure of which are incorporated in its entirety herein by reference.

Carrier D: A solution coating of 64 percent polymethylmethacrylate (PMMA), 6 percent dimethylaminoethylmethacrylate (DMAEMA), and 30 percent conductive carbon black (SC ULTRA, obtained from Conductex).

Carrier E: A powder coating of a mixture of polymers consisting of 73% PMMA and 27% diisopropylaminoethylmethacrylate (DIAEMA).

Carrier F: A solution coating of 76 percent polymethylmethacrylate (PMMA), 4 percent dimethylaminoethylmethacrylate (DMAEMA), and 20 percent conductive carbon black (SC ULTRA, obtained from Conductex).

Carrier G: A solution coating of 72 percent (PMMA), 8 percent dimethylaminoethylmethacrylate (DMAEMA), and 20 percent conductive carbon black (SC ULTRA, obtained from Conductex).

Carrier H: A powder coating consisting of a 1:1 mixture of PMMA polymer and a polymer consisting of 92% methylmethacrylate and 8% DIAEMA.

Toners for each example were prepared by blending RX515H silica, negative additive, and H2050 silica, positive additive, along with SMT5103 titania, and 0.3% zinc stearate onto emulsion aggregation cyan particles in a 10L Henschel blender at 2790 rpm for 20 minutes (Method 1) or, for smaller samples, in an SK-M10 Small Powder Mill (Misaki & Co., Ltd., Tokyo, Japan) at 15K rpm for 60 seconds (15 sec on/45 sec off for four cycles) (Method 2).

Developers were prepared by mixing 4% of a selected toner with a selected carrier on a roll mill or paint shaker. The charge to mass ratio of the toner was measured after 15 minutes on the paint shaker to assure high tribo. The paint shaker mixing was then continued for another 75 minutes to test the developer for charge through. The aggressive mixing was found to simulate the handling of the developer in the HSD development system. After the 90 minutes of paint shaker mixing, 2% additional toner was added to the developer and the charge distribution of the toner population was measured intermittently after further mixing from 15 to 300 seconds.

The charge spectra for these developers, when expressed as particle number (y-axis) plotted against toner charge divided by the toner diameter (x-axis), consisted of one or more peaks, and the toner charge divided by diameter (referred to as toner Q/d) value (values) at the particle number maximum (maxima) served to characterize the developers. Frequently, the charge spectra consisted of two distinct peaks, one for the toner which has been aged aggressively for 90 minutes in the developer (referred to as the incumbent toner) and the other for the toner which was added to the developer after the aggressive mixing (referred to as the fresh toner). In this case, a measure of the quality of the admix was the peak separation (incumbent peak-fresh peak, referred to as delta Q/d). A positive delta Q/d indicated that the fresh toner had a higher Q/d value than the incumbent toner, a phenomena referred to as charge through, whereas a negative delta Q/d indicated that the incumbent toner had a higher Q/d value than the fresh toner, a phenomena referred to as slow admix. The optimum condition was zero delta Q/d, where there was no separation between the incumbent and fresh toner peaks (uninodal distribution) for all mixing times from 15 to 300 seconds.

Examples 1–10

Ratios for each silica and titania component and the carriers used in the developers are shown in Table 1. Several combinations of additives were tried with each carrier in order to obtain optimal performance. The q/m values after 15 and 90 minutes of paint shaker mixing are listed in Table 1. The admix performance of each developer is also shown in Table 1 as i) time at which charge through appeared, ii) slow admix, or iii) good admix.

TABLE 1

| No. | | Negative Charging Additive (RX515H) (wt. %) | Positive Charging Additive (H2050) (wt. %) | Titania (SMT5103) (wt. %) | Blend Method | Carrier | -q/m (μC/g) after 15 min | -q/m (μC/g) after 90 min | Admix Performance |
|---|---|---|---|---|---|---|---|---|---|
| 1 | A | 4.5 | 0.0 | 2.5 | 1 | B | 44 | 26 | 30 |
| | B | 4.0 | 0.5 | 2.5 | 1 | B | 42 | 27 | 30 |
| | C | 3.5 | 1.1 | 2.5 | 1 | B | 32 | 23 | GOOD |
| | D | 3.0 | 1.6 | 2.5 | 1 | B | 31 | 26 | GOOD |
| 2 | A | 4.5 | 0.0 | 2.5 | 1 | A | 36 | 26 | 30 |
| | B | 4.0 | 0.5 | 2.5 | 1 | A | 37 | 32 | 30 |
| | C | 3.5 | 1.1 | 2.5 | 1 | A | 27 | 28 | GOOD |
| | D | 3.0 | 1.6 | 2.5 | 1 | A | 24 | 27 | GOOD |

TABLE 1-continued

| No. | | Negative Charging Additive (RX515H) (wt. %) | Positive Charging Additive (H2050) (wt. %) | Titania (SMT5103) (wt. %) | Blend Method | Carrier | -q/m (μC/g) after 15 min | -q/m (μC/g) after 90 min | Admix Performance |
|---|---|---|---|---|---|---|---|---|---|
| 3 | A | 4.5 | 0.0 | 2.5 | 1 | C1 | 64 | 47 | 300 |
| | B | 4.0 | 0.5 | 2.5 | 1 | C1 | 63 | 47 | 120 |
| | C | 3.5 | 1.1 | 2.5 | 1 | C1 | 56 | 47 | GOOD |
| | D | 3.0 | 1.6 | 2.5 | 1 | C1 | 46 | 40 | GOOD |
| 4 | A | 4.5 | 0.0 | 2.5 | 1 | C2 | 58 | 45 | 30 |
| | B | 4.0 | 0.5 | 2.5 | 1 | C2 | 43 | 37 | GOOD |
| 5 | A | 4.5 | 0.0 | 2.5 | 1 | C3 | 59 | 42 | 30 |
| | B | 4.0 | 0.5 | 2.5 | 1 | C3 | 53 | 34 | 30 |
| | C | 3.5 | 1.1 | 2.5 | 1 | C3 | 38 | 31 | GOOD |
| 6 | A | 4.5 | 0.0 | 2.5 | 1 | D | 59 | 26 | 30 |
| | B | 3.5 | 1.1 | 2.5 | 1 | D | 52 | 37 | 30 |
| | C | 3.0 | 1.6 | 2.5 | 1 | D | 36 | 27 | GOOD |
| 7 | A | 4.0 | 0.5 | 2.5 | 1 | E | 93 | 62 | 30 |
| | B | 3.0 | 1.6 | 2.5 | 1 | E | 74 | 58 | 30 |
| | C | 2.0 | 3.0 | 2.0 | 2 | E | 47 | 47 | 30 |
| | D | 1.0 | 2.0 | 2.0 | 2 | E | 70 | 51 | 30 |
| | E | 1.5 | 3.0 | 2.0 | 2 | E | 51 | 45 | GOOD |
| | F | 2.0 | 4.0 | 2.0 | 2 | E | 10 | 25 | Slow Admix |
| 8 | A | 4.0 | 0.5 | 2.5 | 1 | F | 63 | 37 | 30 |
| | B | 1.0 | 2.0 | 2.0 | 2 | F | 32 | 27 | GOOD |
| | C | 1.5 | 3.0 | 2.0 | 2 | F | 29 | 30 | Slow Admix |
| 9 | A | 4.0 | 0.5 | 2.5 | 1 | G | 62 | 40 | 30 |
| | B | 1.5 | 3.0 | 2.0 | 2 | G | 26 | 23 | Slow Admix |
| 10 | A | 4.0 | 0.5 | 2.5 | 1 | H | 86 | 60 | 30 |
| | B | 1.0 | 2.0 | 2.0 | 2 | H | 70 | 55 | GOOD |
| | C | 1.5 | 3.0 | 2.0 | 2 | H | 67 | 66 | Slow Admix |

It is evident from the tabulated q/m values that the amine containing carrier coatings result in larger negative toner q/m values. The q/m values tend to decrease as the ratio of the negative silica to positive silica decreases. However, toners that were blende without H2050 silica exhibited charge through. For each carrier, charge through was fixed by using some ratio of RX515H/H2050 additive combination (SMT5103 titania held constant at 2 to 2.5% and ZnSt-L at 0.3%). It should be noted that for the more "positive" carriers, the ratio of H2050 to RX515H is much higher.

Other Examples

In addition to the RX515H/H2050 additive combination, additive blends with RX50/H2050 (optimal values ~3%/1.6%), NA50HS/H2050 (optimal values ~3%/1.6%), and Cabosil TG308F/H2050 (optimal values ~3.5%/1%) were also prepared and demonstrated the applicability of the concept of using negative and positive additives to eliminate charge through. In each case, charge through is either mitigated or eliminated.

Toners with RX515H/Al2O3 (optimal values ~3.5%4%), $Al_2O_3$ (fluorosilane treated)/H2050 silica, $Al_2O_3$ (fluorosilane treated)/$Al_2O_3$ (aminosilane treated) additive packages are also possible, as are additive packages of negative and positive chargeable microspheres.

Aluminum oxide surface additives, untreated, such as Alumina-C (Degussa), Cabosil Aluminas, or aluminas which have been treated with fluorosilanes as negative chargeable additives, and aluminum oxide additives treated with long chain alkyl silanes such as decylsilane and aminosilanes for positive charging applications, may be used together as negative and positive chargeable aluminas in an additive package of the invention to suppress charge through and give fast admix.

What we claim is:

1. An emulsion aggregation toner comprised of toner particles comprising polymer binder and colorant and a surface additive package comprising at least titania, at least one negative additive negatively chargeable to a reference carrier and at least one positive additive positively chargeable to the reference carrier.

2. The emulsion aggregation toner according to claim 1, wherein the at least one negative additive comprises particles selected from the group consisting of silica, alumina and polymeric microspheres having a volume average particle diameter of from about 7 to about 100 nm.

3. The emulsion aggregation toner according to claim 2, wherein the particles are treated with a composition selected from the group consisting of fluorosilanes, silazanes and siloxanes.

4. The emulsion aggregation toner according to claim 1, wherein the surface additive package further contains zinc stearate.

5. The emulsion aggregation toner according to claim 1, wherein the at least one positive additive comprises particles selected from the group consisting of silica, alumina and polymeric microspheres having a volume average particle diameter of from about 7 to about 100 nm, and treated with a composition.

6. The emulsion aggregation toner according to claim 5, wherein the particles are treated with a composition selected from the group consisting of alkylsilane and aminosilanes.

7. The emulsion aggregation toner according to claim 1, wherein the surface additive package preferably includes from about 0.5% to about 15% by weight of the toner of the at least one negative additive and from about 0.5% to about 12% by weight of the toner of the at least one positive additive.

8. The emulsion aggregation toner according to claim 1, wherein a ratio of the at least one negative additive to the at least one positive additive in the surface additive package ranges from about 90:10 to about 30:70, weight basis.

9. The emulsion aggregation toner according to claim 1, wherein the polymer binder comprises a sodio sulfonated polyester formed by emulsion aggregation and has a particle size of from about 3 to about 9 microns and a narrow geometric size distribution of from about 1.05 to about 1.25.

10. The emulsion aggregation toner according to claim 1, wherein the colorant is a pigment or a dye.

11. A method of preparing the emulsion aggregation toner of claim 1, comprising forming toner particles comprised of polymer binder and colorant by emulsion aggregation, and incorporating a surface additive package comprising at least one negative additive negatively chargeable to a reference carrier and at least one positive additive positively chargeable to the reference carrier onto the toner particles.

12. The method according to claim 11, wherein the emulsion aggregation comprises forming an emulsion latex of particles of the polymer binder having a size of from about 5 to about 500 nanometers in diameter by heating the polymer in water, adding a colorant dispersion comprised of colorant dispersed in water and optionally additional polymer binder to the emulsion latex, aggregating the particles to form aggregated toner particles of polymer and colorant, and coalescing or fusing the aggregated toner particles to form the emulsion aggregation toner of aggregated, fused toner particles.

13. A developer comprising the emulsion aggregation toner of claim 1 and carrier.

14. The developer according to claim 13, wherein the developer has a toner charge to mass ratio of from about −30 to about −60 $\mu$C/g.

15. The developer according to claim 13, wherein a concentration of the toner in the developer is from about 2 to about 8 weight percent.

16. The developer according to claim 13, wherein the carrier comprises a steel core coated with a coating comprising fluorocarbon polymers, acrylate polymers, methacrylate polymers, silicone polymers, polyurethanes, or mixtures thereof.

17. The developer according to claim 13, wherein the at least one negative additive comprises particles selected from the group consisting of silica, alumina and polymeric microspheres having a volume average particle diameter of from about 7 to about 100 nm.

18. The developer according to claim 17, wherein the particles are treated with a composition selected from the group consisting of fluorosilanes, silazanes and siloxanes.

19. The developer according to claim 13, wherein the surface additive package further contains zinc stearate.

20. The developer according to claim 13, wherein the at least one positive additive comprises particles selected from the group consisting of silica, alumina and polymeric microspheres having a volume average particle diameter of from about 7 to about 100 nm, and treated with a composition.

21. The developer according to claim 20, wherein the particles are treated with a composition selected from the group consisting of alkylsilane and aminosilanes.

22. A method of making a developer comprised of emulsion aggregation toner and carrier, comprising determining a charging effect the carrier imparts to the toner at a selected concentration of toner to carrier;

preparing a surface additive package comprising a mixture of at least titania, at least one negative additive and at least one positive additive, wherein a ratio of the negative additive to the positive additive in the mixture is selected based upon the determined charging effect;

incorporating the surface additive package onto the toner; and subsequently mixing the toner and the carrier.

23. The method according to claim 22, wherein the ratio of the at least one negative additive to the at least one positive additive in the mixture decreases as the charging effect of the carrier becomes more positive.

* * * * *